US007661661B2

(12) United States Patent
Schmidt

(10) Patent No.: US 7,661,661 B2
(45) Date of Patent: Feb. 16, 2010

(54) EVAPORATOR ASSEMBLY UNIT, ESPECIALLY FOR A VEHICLE HEATER OR A REFORMER ARRANGEMENT OF A FUEL CELL SYSTEM

(75) Inventor: Oliver Schmidt, Plochingen (DE)

(73) Assignee: J. Eberspächer GmbH & Co. KG, Esslingen (DE)

( * ) Notice: Subject to any disclaimer, the term of this patent is extended or adjusted under 35 U.S.C. 154(b) by 314 days.

(21) Appl. No.: 11/750,020

(22) Filed: May 17, 2007

(65) Prior Publication Data

US 2007/0273052 A1 Nov. 29, 2007

(30) Foreign Application Priority Data

May 23, 2006 (DE) ..... 10 2006 024 221

(51) Int. Cl.
*B01F 3/04* (2006.01)

(52) U.S. Cl. ..... 261/104; 261/DIG. 65; 261/DIG. 83; 429/12; 431/261

(58) Field of Classification Search ..... 261/104, 261/107, 143–145, 154, DIG. 65, DIG. 83; 431/261, 326–329; 429/12
See application file for complete search history.

(56) References Cited

U.S. PATENT DOCUMENTS

| | | | | | |
|---|---|---|---|---|---|
| 2,431,456 | A | * | 11/1947 | Bock | 431/261 |
| 2,966,945 | A | * | 1/1961 | Downs | 198/674 |
| 3,245,457 | A | * | 4/1966 | Smith et al. | 431/6 |
| 3,531,229 | A | * | 9/1970 | Berglund | 431/262 |
| 4,669,974 | A | * | 6/1987 | Sawada et al. | 431/154 |
| 5,707,227 | A | * | 1/1998 | Langen et al. | 431/261 |
| 5,894,988 | A | | 4/1999 | Brenner et al. | |
| 5,993,197 | A | * | 11/1999 | Alber et al. | 431/261 |
| 6,027,334 | A | | 2/2000 | Blaschke | |
| 6,811,395 | B2 | * | 11/2004 | Schlecht | 431/261 |
| 6,929,467 | B2 | * | 8/2005 | Blaschke et al. | 431/261 |
| 7,229,279 | B2 | * | 6/2007 | Wahl et al. | 431/261 |
| 2003/0118964 | A1 | * | 6/2003 | Blaschke et al. | 431/262 |
| 2004/0209214 | A1 | | 10/2004 | Wahl et al. | |

FOREIGN PATENT DOCUMENTS

| | | | |
|---|---|---|---|
| DE | 3914611 | A1 * | 12/1989 |
| DE | 42 44 400 | A1 | 6/1994 |
| DE | 295 04 298 | U1 | 5/1995 |
| DE | 195 29 994 | A1 | 4/1996 |
| DE | 102 55 361 | B3 | 6/2004 |
| EP | 1 243 850 | A1 | 9/2002 |
| EP | 1 553 653 | A2 | 7/2005 |
| EP | 1 647 769 | A1 | 4/2006 |
| GB | 2 243 904 | A | 11/1991 |
| WO | WO 82100332 | | 2/1982 |

* cited by examiner

*Primary Examiner*—Richard L Chiesa
(74) *Attorney, Agent, or Firm*—McGlew and Tuttle, P.C.

(57) ABSTRACT

An evaporator assembly unit, especially for a vehicle heater or a reformer arrangement of a fuel cell system, includes a wall arrangement (12) enclosing an evaporation chamber (20) with a circumferential wall (14) and with a bottom wall (16). An air introduction shoulder (18) extending in the direction of a wall longitudinal axis (L) is provided with a plurality of first air introduction openings (22). Evaporator medium (26), that is porous at least in some areas, is provided on the side of the wall arrangement (12) facing the evaporation chamber (20). An auxiliary air opening arrangement (34) with at least one second air introduction opening (36) is provided in the wall arrangement (12).

16 Claims, 2 Drawing Sheets

EVAPORATOR ASSEMBLY UNIT, ESPECIALLY FOR A VEHICLE HEATER OR A REFORMER ARRANGEMENT OF A FUEL CELL SYSTEM

CROSS REFERENCE TO RELATED APPLICATIONS

This application claims the benefit of priority under 35 U.S.C. §119 of German Patent Application DE 10 2006 024 221.1 filed May 23, 2006, the entire contents of which are incorporated herein by reference.

FIELD OF THE INVENTION

The present invention pertains to an evaporator assembly unit, especially for a vehicle heater or a reformer arrangement of a fuel cell system, comprising a wall arrangement enclosing an evaporation chamber with a circumferential wall and a bottom wall, wherein an air introduction shoulder extending in the direction of a wall longitudinal axis with a plurality of first air introduction openings is provided at the bottom wall and wherein an evaporator medium that is porous at least in some areas is provided on the side of the wall arrangement facing the evaporation chamber.

BACKGROUND OF THE INVENTION

Such evaporator assembly units are used, for example, for evaporative burners in vehicle heaters. The liquid fuel, in general, the fuel that is also used in a vehicle, is fed here into the porous evaporator medium via a feed line arrangement, distributed in this porous evaporator medium by capillary action and optionally under the action of the force of gravity, and then evaporated on the side of the porous evaporator medium exposed towards the evaporation chamber. The air necessary for mixing with the fuel vapor is introduced into a central area of the evaporation chamber via the air introduction shoulder. This leads to a comparatively good mixing of the air introduced and the fuel vapor, so that a combustible mixture can be made available essentially over the entire volume area of the evaporation chamber. This [mixture] is then ignited and burned during the heating operation, and the heat generated during the combustion is then transferred to a heat carrier medium, for example, into air to be introduced into the interior space of a vehicle or into a liquid medium.

Furthermore, such an evaporator assembly unit may also be used to make available a mixture containing fuel or hydrocarbon vapor in a reformer arrangement, which mixture will then be converted into a gas containing hydrogen in a reforming process taking place at a catalytic material. Consequently, the evaporator assembly unit is used to convert a medium, which is fed in at first in the liquid form and contains hydrocarbon, and which may likewise be the fuel used in a vehicle, into a vapor phase in this case as well. It is, of course, also possible when using such an evaporator assembly unit in a reformer arrangement to mix and burn the hydrocarbon vapor generated, for example, during the start phase, with air, which is likewise introduced, in order to make it possible to make available the high temperatures necessary for the start of the reforming process, especially in the area of the catalytic material of the reformer arrangement.

SUMMARY OF THE INVENTION

The object of the present invention is to design such an evaporator assembly unit such that the mixture formation process and the heat balance of the assembly unit are improved.

This object is accomplished according to the present invention by an evaporator assembly unit, especially for a vehicle heater or a reformer arrangement of a fuel cell system, comprising a wall arrangement enclosing an evaporation chamber with a circumferential wall and a bottom wall, wherein an air introduction shoulder extending in the direction of a wall longitudinal axis with a plurality of first air introduction openings is provided at the bottom wall and wherein an evaporator medium that is porous at least in some sections is provided on the side of the wall arrangement facing the evaporation chamber, and also comprising, furthermore, an auxiliary air opening arrangement with at least one second air introduction opening in the wall arrangement.

Consequently, the air introduced to form the mixture is introduced into the evaporator assembly unit according to the present invention not only via the air introduction shoulder provided at the bottom wall and extending into the evaporation chamber, but additionally via at least one opening provided in the area of the wall arrangement, i.e., the bottom wall and/or of the circumferential wall. This advantageously affects the flow within the evaporation chamber, especially in conjunction with the selection of the position and the shape of such an additional opening, and leads to a more uniform and better mixing of the fuel vapor with the air introduced and reduces the risk of formation of deposits when such an evaporation chamber is also used for the combustion operation. Furthermore, such an opening in the wall arrangement represents an interruption, which greatly affects the heat flow in the wall arrangement, which is made, in general, of a metallic material. It becomes possible in this manner to more strongly uncouple thermally areas of the wall arrangement, which are to be protected from excessive heating, from more intensely heated areas.

Provisions may be made, for example, for the auxiliary air opening arrangement to comprise at least one second air introduction opening in the circumferential wall.

In order to compromise the introduction of the air through the at least one second air introduction opening as little as possible, it is proposed that at least one part of the porous evaporator medium be provided at the circumferential wall and that the at least one second air introduction opening be provided in an area of the circumferential wall not covered by the porous evaporator medium.

It is possible, for example, that the porous evaporator medium is provided essentially in the area of the circumferential wall located essentially in the area in which the air introduction shoulder extends axially.

To improve the thermal uncoupling while providing at the same time the at least one second air introduction opening, it is proposed that the circumferential wall comprise two wall components, which follow each other in the direction of the longitudinal axis of the wall and are rigidly connected to one another, and that the auxiliary air opening arrangement comprise at least one second air introduction opening formed by an intermediate space between the wall components.

Provisions may be made here, for example, for the second wall components to be rigidly connected to one another at a plurality of circumferential areas via the interposition of spacers and for a second air introduction opening to be formed at least in one area between two spacers following each other in the circumferential direction.

As an alternative or in addition, it is possible for the auxiliary air opening arrangement to comprise at least one second air introduction opening in the bottom wall in an area surrounding the air introduction shoulder (or shoulder insert).

The air flow and the thermal behavior of the evaporator assembly unit can be affected especially strongly and advantageously by the auxiliary air opening arrangement comprising a plurality of second air introduction openings following each other in the circumferential direction.

Furthermore, it is possible that at least one second air introduction opening is elongated (e.g., in a circumferential direction). In particular, the provision of elongated air introduction openings for the auxiliary air opening arrangement leads to a very strong thermal uncoupling of different areas of the wall arrangement with a comparatively large opening cross section.

Furthermore, an air feed arrangement may be provided in the evaporator assembly unit according to the present invention for feeding air to be introduced into the evaporation chamber in the direction of the bottom wall of the wall arrangement.

Especially if the auxiliary air opening arrangement comprises at least one second air introduction opening in the circumferential wall, it is advantageous if the air introduction arrangement is designed, furthermore, for introducing air in the direction of the circumferential wall of the wall arrangement.

The present invention will be explained in detail below with reference to the attached drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
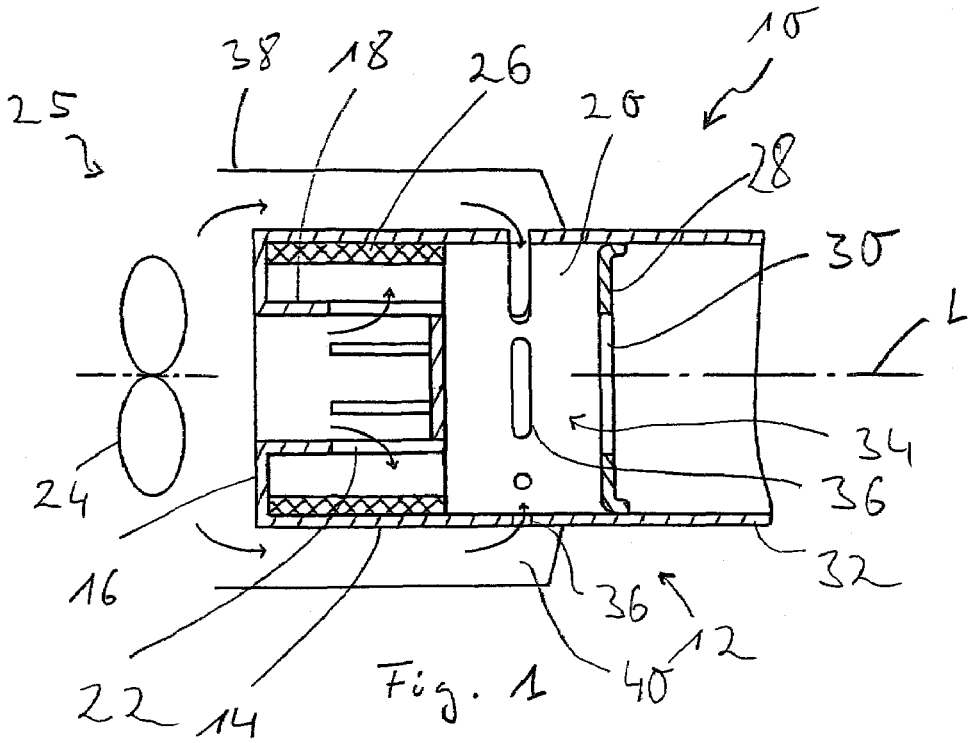
FIG. 1 is a longitudinal sectional view of an evaporator assembly unit designed according to the present invention.

Referring to the drawings in particular, An evaporator assembly unit is generally designated by 10 in FIG. 1. This evaporator assembly unit 10, which can be inserted, for example, into an evaporative burner of a vehicle heater, in which the heat generated by combustion is transferred to a heat carrier medium, comprises a wall arrangement generally designated by 12 with a circumferential wall 14 and with a bottom wall 16. The circumferential wall 14 and the bottom wall 16 of the wall arrangement 12 form a pot-like assembly unit elongated in the direction of a longitudinal axis L of the wall. The circumferential wall 14 and the bottom wall 16 are designed in the example being shown as integral components of the wall arrangement 12, which can be manufactured, for example, by a casting process from metallic material. The circumferential wall 14 and the bottom wall 16 could, of course, also be made available as separate components and assembled subsequently.

An air introduction shoulder 18 begins from the bottom wall 16 in the central area of the bottom wall 16 in the direction of the wall longitudinal axis L. This shoulder 18, just as the circumferential wall 14, may be of a cylindrical, for example, regular cylindrical shape, and it extends into an evaporation chamber 20, which is enclosed by the circumferential wall 14 and the bottom wall 16 and which can also be called a combustion chamber if the evaporator assembly unit 10 is used in an evaporative burner.

A plurality of slot-like first air introduction openings 22, which likewise extend, for example, in the direction of the wall longitudinal axis L and via which the air delivered by an air delivery blower 24 of an air delivery arrangement generally designated by 25 can flow into the evaporation chamber 20, as is indicated by flow arrows, are present in the air introduction shoulder. It shall be pointed out here that the air delivery blower 24 is presented only symbolically and could be designed, for example, as a by-pass channel blower. Furthermore, it is possible that an air introduction arrangement with a plurality of blades extending helically is provided in the area of the bottom wall 16 on the side thereof facing away from the evaporation chamber 20, so that a twist can be additionally imposed on the air flowing into the air introduction shoulder.

A porous evaporator medium 26 is provided on a side of the circumferential wall 14 facing the evaporation chamber 20. This porous evaporator medium 26, built up, for example, from wire mesh, knitted wire, foam ceramic or the like, extends along the circumferential wall 14 starting from the bottom wall 16 approximately in the axial area, in which the air introduction shoulder 18 extends as well. The porous evaporator medium 26 is preferably designed such that it covers the entire circumferential wall 14 in the circumferential direction in the axial area shown.

Liquid fuel or hydrocarbon is introduced into this porous evaporator medium 26 via a fuel guide arrangement, not shown, and distributed in the inner volume area of the evaporator medium and then released on the side of the porous evaporator medium 26, which side is freely exposed towards the evaporation chamber 20. It shall be pointed out here that one or more shoulders, which extend outwardly, for example, tangentially from the circumferential wall 14 and which may likewise be lined with porous evaporator medium and used to receive an igniting member or for introducing the fuel, could be provided, for example, at the circumferential wall 14.

A flame screen 28 with a central opening 30 is arranged on the inner side of the circumferential wall 14 in an area located farther away from the bottom wall 16. When combustion is taking place, this flame screen 28 essentially limits the evaporation chamber or combustion chamber 20, and the combustion waste gases and the flame will move into a next section of the circumferential wall, which is generally also called flame tube 32. It is obvious that the flame tube 32, as is shown, may be made integral with the area of the circumferential wall 14 forming the evaporation chamber 20, but it may, of course, also be designed as a separate component.

Furthermore, an auxiliary air opening arrangement 34 with a plurality of second air introduction openings 36, which are provided in the circumferential wall 14 here, are provided in the evaporator assembly unit 10 next to the air introduction shoulder 18. These second air introduction openings 36 may be provided in the circumferential direction around the wall longitudinal axis L following each other approximately in the same axial area of the circumferential wall 14, namely, in the area that is no longer covered by the porous evaporator medium 26. It is recognized in FIG. 1 that the second air introduction openings 36 may have a different shape. Thus, as is shown in the upper part of FIG. 1, they may be elongated in the circumferential direction, or they may be circular, as is shown in the lower part of FIG. 1. A combination of elongated and circular second air introduction openings 36 is, of course, possible, as is a combination of second air introduction openings located in different axial areas of the circumferential wall 14.

To make it possible to guide the air being delivered by the air delivery blower 24 in the direction of the wall arrangement 12 not only to the bottom wall 16 and thus into the air introduction shoulder 18, but also to the auxiliary air opening arrangement 34, the air feed arrangement 25 comprises, furthermore, an outer wall or an outer housing 38, which, surrounding the circumferential wall 14, provides with the latter a, for example, annular flow space 40. This annular flow space 40 leads to the second air introduction openings 36 of the auxiliary air opening arrangement 34, so that the air being delivered by the air delivery blower 24 can also enter through the second air introduction openings 36 into the evaporation chamber 20, as is indicated by flow arrows.

Various advantages are gained with the design of an evaporator assembly unit shown in FIG. 1 during the evaporation or combustion operation. Thus, by additionally introducing air, a markedly better mixing of the fuel vapor being released via the porous evaporator medium 26 with the air being introduced is achieved. As a consequence, the combustion taking place or started in the evaporation chamber 20 will take place with a better quality and hence with the formation of a reduced amount of pollutants. Furthermore, the risk of fuel deposits or deposits of combustion residues is reduced. By providing the auxiliary air opening arrangement 34, a sharper physical separation of the sections of the circumferential wall 14 located on the two axial sides of the second air introduction openings 36 is achieved. Since the area of the circumferential wall 14, which is located to the right of the second air introduction openings 38 in the view shown in FIG. 1 and hence farther downstream in the direction of flow of the combustion waste gases, which said area is also used as a flame tube 32, is heated intensely during the combustion taking place, a sharper thermal uncoupling of the area of the circumferential wall 14 or wall arrangement 12, which also surrounds above all the porous evaporator medium 26, is achieved due to the interruptions in the circumferential wall 14. This is advantageous especially when low-boiling fuels are used. The extent of the thermal uncoupling can, of course, be strongly affected here by the size of the interruptions formed in the wall arrangement 12 in the circumferential direction. Furthermore, the flow of the air to be introduced into the evaporation chamber 20 via the second air introduction openings 36 past the circumferential wall 14 through the annular flow space 40 leads to an additional cooling of the area of the circumferential wall 14 in which the porous evaporator medium 26 is provided and the fuel is also introduced. The risk of boiling of fuel is thus counteracted, and the air to be introduced into the evaporation chamber 20 can also be heated during its flow through the flow space 40.

Figure 2:
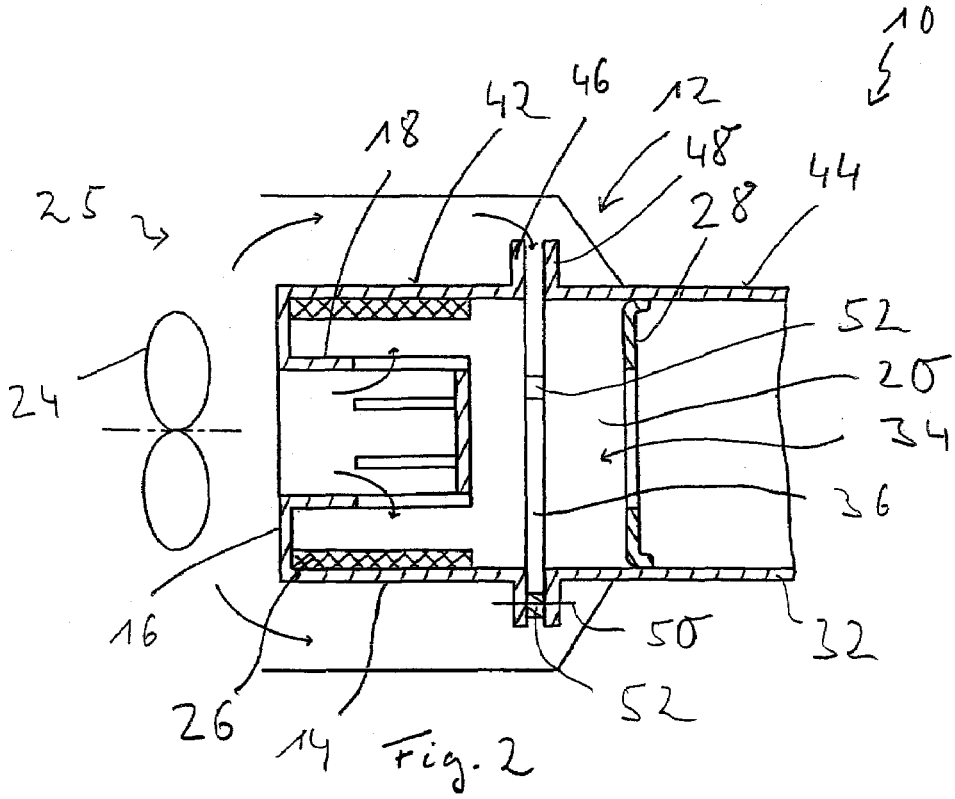
FIG. 2 is a view corresponding to FIG. 1 of an evaporator assembly unit of an alternative design.

FIG. 2 shows a variant of the embodiment shown in FIG. 1, in which an auxiliary air opening arrangement 34 is likewise provided in the area of the circumferential wall 14. It is recognized that the wall arrangement 12 comprises two wall components 42, 44 here, of which the wall component 42 provides the bottom wall 16 and an adjoining section of the circumferential wall 14. This is especially also the area of the circumferential wall 14 in which the porous evaporator medium 26 is arranged. The wall component 44 axially joins the wall component 42 and thus likewise represents an area of the circumferential wall 14 or the area of the circumferential wall 14 that is also the area acting as the flame tube 32. Furthermore, the flame screen 28 may be provided in this wall component 44.

The two wall components 42, 44 are provided with radially outwardly directed flange sections 46, 48. The two wall components 42, 44 are rigidly connected to one another by connection elements 50, which are schematically indicated in FIG. 2, for example, screws or clinched bolts or the like, via the intermediary of spacers 52, in the area of these flange sections 42, 44 in a plurality of circumferential positions. An annular gap, which is interrupted by the spacers 52, is thus formed between the two wall components 42, 44, and the gap sections formed between consecutive spacers 52 in the circumferential direction provide the second air introduction openings 36 of the auxiliary air opening arrangement 34. Thus, the possibility of introducing air into the area of the evaporation chamber 20 through a plurality of elongated second air introduction openings 36 in the circumferential wall 14, which said openings 36 follow each other in the circumferential direction, is thus created again. The same advantages as those described above arise concerning the mixing with the evaporated fuel and also the thermal uncoupling. In particular, the thermal uncoupling can, however, be achieved even better by the fact that materials with poor thermal conduction are used for the spacers 52, which form heat bridges between the two wall components 42, 44. The flow conditions and the thermal uncoupling can, of course, again be affected strongly by the design of the spacers 52 and a possibly annular spacer provided with through openings for providing the second air introduction openings 36.

Figure 3:
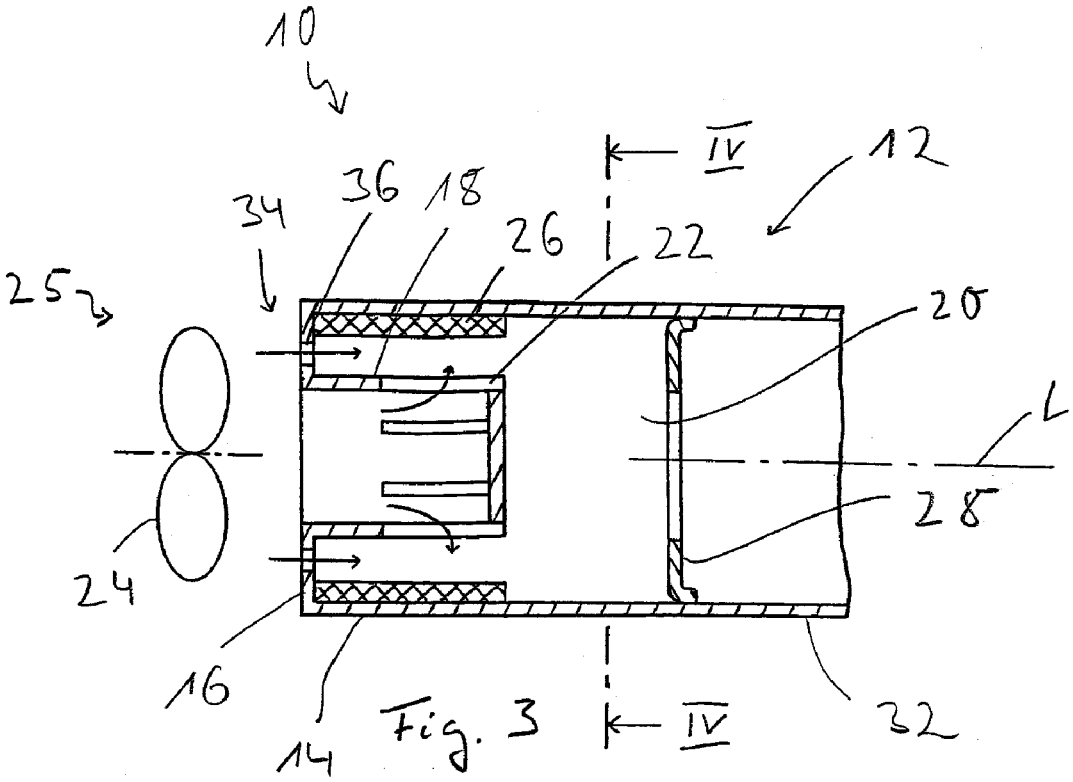
FIG. 3 is another view corresponding to FIG. 1 of an evaporator assembly unit of an alternative design.
Figure 4:
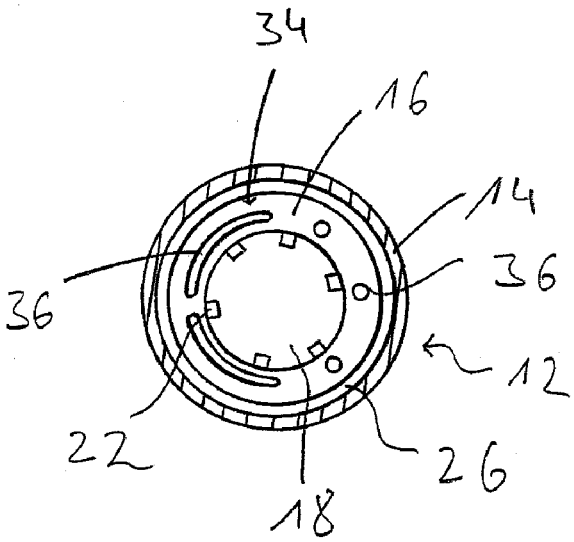
FIG. 4 is a cross-sectional view of the evaporator assembly unit shown in FIG. 3, cut along a line IV-IV in FIG. 3.

Another embodiment of an evaporator assembly unit with an auxiliary air opening arrangement is shown in FIGS. 3 and 4. A design that is, in principle, similar to that shown in FIG. 1 is recognized here. However, the auxiliary air opening arrangement 34 is provided here with its second air introduction openings 36 in the area of the bottom wall 16. The second air introduction openings 36 are located in the annular area of the bottom wall 16 surrounding the air introduction shoulder 18 and thus they likewise form, as can be recognized from FIG. 4, a sequence of openings following each other in the circumferential direction around the wall longitudinal axis L. As is indicated in FIG. 4, a plurality of shapes or dimensions of the second air introduction openings are possible here as well. Thus, these second air introduction openings may be elongated in the circumferential direction, as is shown in the left-hand part of FIG. 4, or they may be, for example, circular, as is shown in the right-hand part of FIG. 4.

A markedly better mixing of the evaporating fuel with the air being introduced is also achieved with this embodiment of the auxiliary air opening arrangement 34. It is highly advantageous that starting from the bottom wall 16, an air flow stream is provided essentially in parallel to the surface of the porous evaporator medium 26, which transports the fuel evaporated from there into the area of the evaporation chamber 20, which latter area follows it in the axial direction. The transport of the heat absorbed during the combustion taking place in the area of the air introduction shoulder 18 is also made difficult in the direction of the area of the circumferential wall 14 in which the porous evaporator medium 26 is provided, so that the risk of excessively intense or too early boiling of fuel can be eliminated here as well.

By providing the auxiliary air opening arrangement 34, improved evaporation and mixing properties are ensured in an evaporator assembly unit 10 of such a design, and lower pollutant emissions and reduced amount of deposits of combustion residues are ensured during the combustion. Furthermore, the heat balance can be strongly affected by the selection of the number, the selection of the shape and the selection of the positioning of the second air introduction openings 36, especially in the area in which the fuel is to be fed in and evaporated. This makes it possible to design such an evaporator assembly unit specifically for a fuel that is to be used such that combustion characteristics that are optimal for that particular fuel can be obtained. This is especially advantageous when biological fuels, e.g., PME (vegetable oil methyl ester) or rapeseed oil or the like, are to be used, whose combustion characteristics differ markedly from those of conventional fuels, e.g., gasoline.

While specific embodiments of the invention have been shown and described in detail to illustrate the application of the principles of the invention, it will be understood that the invention may be embodied otherwise without departing from such principles.

What is claimed is:

1. An evaporator assembly unit for a vehicle heater or a reformer arrangement of a fuel cell system, the evaporator assembly unit comprising:

a wall arrangement enclosing an evaporation chamber with a circumferential wall with a wall longitudinal axis and with a bottom wall;

an air introduction shoulder provided at said bottom wall and extending in the direction of said wall longitudinal axis and with a plurality of air introduction openings;

a porous evaporator medium provided on a side of said wall arrangement facing said evaporation chamber at least in some sections; and an auxiliary air opening arrangement having at least one auxiliary air introduction opening in said wall arrangement, at least one auxiliary air introduction opening being provided in said circumferential wall, said circumferential wall comprising two wall components which follow each other in the direction of said wall longitudinal axis, said two wall components being rigidly connected to one another, said auxiliary air introduction opening being formed by an intermediate space between said two wall components.

2. An evaporator assembly unit in accordance with claim 1, wherein at least part of said evaporator medium is provided at said circumferential wall and said auxiliary air introduction opening is provided in an area of said circumferential wall not covered by said evaporator medium.

3. An evaporator assembly unit in accordance with claim 2, wherein said evaporator medium is provided essentially in an area of said circumferential wall located in an area in which said air introduction shoulder extends axially.

4. An evaporator assembly unit in accordance with claim 1, wherein said two wall components are rigidly connected to one another in a plurality of circumferential areas via intermediary spacers, wherein said auxiliary air introduction opening is formed at least in one area between two said spacers following each other in a circumferential direction.

5. An evaporator assembly unit in accordance with claim 1, wherein at least one auxiliary air introduction opening is provided in said bottom wall in an area surrounding an air introduction insert.

6. An evaporator assembly unit in accordance with claim 1, wherein said auxiliary air opening arrangement comprises a plurality of auxiliary air introduction openings following each other in the circumferential direction.

7. An evaporator assembly unit in accordance with claim 6, wherein at least one introduction opening is elongated.

8. An evaporator assembly unit in accordance with claim 1, further comprising an air feed arrangement for feeding air to be introduced into said evaporation chamber in a direction of said bottom wall of said wall arrangement.

9. An evaporator assembly unit in accordance with claim 8, wherein said air feed arrangement comprises means for feeding air in a direction of said circumferential wall of said wall arrangement.

10. An evaporator assembly unit comprising:

a wall arrangement including a circumferential wall extending in an axial direction and with a bottom wall, said wall arrangement defining an evaporation chamber;

an air introduction shoulder extending interiorly of said circumferential wall and in the axial direction from said bottom wall, said air introduction shoulder having a plurality of air introduction openings;

an at least partially porous evaporator medium provided on a side of said wall arrangement facing said air introduction shoulder; and an auxiliary air opening arrangement with an auxiliary air introduction opening in said wall arrangement, said circumferential wall comprising two wall components which follow each other in the axial direction, said two wall components being rigidly connected to one another, said auxiliary air introduction opening being formed by an intermediate space between said two wall components.

11. An evaporator assembly unit in accordance with claim 10, further comprising:

an air feed arrangement for feeding air to be introduced into said evaporation chamber in the axial direction into an interior of said air introduction shoulder and through said plurality of air introduction openings into said evaporation chamber, wherein said auxiliary air opening arrangement includes said auxiliary air introduction opening and at least one further auxiliary air introduction opening to provide a plurality of auxiliary air introduction openings in said circumferential wall and said air feed arrangement comprises means for feeding air to said auxiliary air introduction openings for air to flow radially into said evaporation chamber.

12. An evaporator assembly unit in accordance with claim 11, wherein at least part of said evaporator medium is provided at said circumferential wall and said auxiliary air introduction openings are provided in an area of said circumferential wall not covered by said evaporator medium.

13. An evaporator assembly unit in accordance with claim 12, wherein said evaporator medium is provided essentially in an area of said circumferential wall located in an area in which said air introduction shoulder extends axially.

14. An evaporator assembly unit in accordance with claim 10, wherein said two wall components are rigidly connected to one another in a plurality of circumferential areas via intermediary spacers, wherein said auxiliary air introduction openings are formed between two circumferentially adjacent said spacers.

15. An evaporator assembly unit in accordance with claim 11, wherein at least one said second air introduction openings is elongated in the circumferential direction.

16. An evaporator assembly unit in accordance with claim 10, further comprising: an air feed arrangement for feeding air to be introduced into said evaporation chamber in the axial direction into an interior of said air introduction shoulder and through said plurality of air introduction openings into said evaporation chamber, wherein said auxiliary air opening arrangement includes said auxiliary air introduction opening and at least one further auxiliary air introduction opening to provide a plurality of auxiliary air introduction openings in said bottom wall in an area surrounding said air introduction shoulder and said air feed arrangement comprises means for feeding air to said auxiliary air introduction openings for air to flow axially into said evaporation chamber.

* * * * *